US008919734B2

(12) United States Patent
Fu et al.

(10) Patent No.: US 8,919,734 B2
(45) Date of Patent: Dec. 30, 2014

(54) HOLLOW FLOOR-JACK WEB-PLATE TYPE CHASSIS SIDE PANEL ASSEMBLY

(71) Applicant: Jiashan Handijack Tools Corp., Jiashan, Zhejiang (CN)

(72) Inventors: Yong-gang Fu, Zhejiang (CN); Xiao-yuan Fang, Zhejiang (CN)

(73) Assignee: Jiashan Handijack Tools Corp., Jiashan, Zhejiang (CN)

( * ) Notice: Subject to any disclaimer, the term of this patent is extended or adjusted under 35 U.S.C. 154(b) by 144 days.

(21) Appl. No.: 13/842,790

(22) Filed: Mar. 15, 2013

(65) Prior Publication Data

US 2014/0199559 A1 Jul. 17, 2014

(30) Foreign Application Priority Data

Jan. 12, 2013 (CN) ..... 2013 1 0012616

(51) Int. Cl.
*B66F 5/04* (2006.01)

(52) U.S. Cl.
CPC ..... *B66F 5/04* (2013.01)
USPC ..... 254/2 B

(58) Field of Classification Search
CPC ..... B66F 5/04; B66F 5/02; B66F 5/00; B66F 3/36; B62B 3/0625; B62B 3/0618
USPC ..... 254/2 B, 3 B, 5 B, 10 B, 93 L, DIG. 1
See application file for complete search history.

(56) References Cited

U.S. PATENT DOCUMENTS

| | | | | | |
|---|---|---|---|---|---|
| 1,553,074 | A | * | 9/1925 | Engel | 254/9 B |
| 1,559,099 | A | * | 10/1925 | Hopkins | 254/2 B |
| 1,570,071 | A | * | 1/1926 | Mercier | 254/2 B |
| 1,652,406 | A | * | 12/1927 | Hopkins | 254/7 B |
| 1,674,397 | A | * | 6/1928 | Hopkins | 254/6 B |
| 1,674,813 | A | * | 6/1928 | Weaver et al. | 254/2 B |
| 1,684,180 | A | * | 9/1928 | Hopkins | 254/2 B |
| 1,750,598 | A | * | 3/1930 | Holmes | 254/2 B |
| 1,794,525 | A | * | 3/1931 | Lucker | 254/2 B |
| 1,805,588 | A | * | 5/1931 | Manley | 60/468 |
| 1,811,085 | A | * | 6/1931 | Hopkins | 254/2 B |
| 1,818,077 | A | * | 8/1931 | Manley et al. | 254/6 B |
| 1,819,378 | A | * | 8/1931 | Nilson | 254/2 B |
| 1,940,823 | A | * | 12/1933 | Shinn | 254/2 B |
| 1,942,244 | A | * | 1/1934 | Green et al. | 254/2 B |
| 1,945,910 | A | * | 2/1934 | Nilson | 254/2 B |
| 1,948,073 | A | * | 2/1934 | Manley | 254/2 B |
| 1,951,398 | A | * | 3/1934 | Dearsley | 254/2 B |

(Continued)

*Primary Examiner* — Lee D Wilson
*Assistant Examiner* — Jamal Daniel
(74) *Attorney, Agent, or Firm* — Muncy, Geissler, Olds & Lowe, P.C.

(57) ABSTRACT

A hollow floor-jack web-plate type chassis side panel assembly includes a side panel, a reserved installation hole on the side panel, a side panel bent edge at a lower edge of the side panel, and a web plate having an installation hole corresponding to the web plate. The web plate has an edge including first and second web plate molded edges which are perpendicular to the web plate and arranged in the same direction; the first web plate molded edge is attached and welded onto a side panel bent edge facing away from the side panel; the second web plate molded edge is attached and welded at a position on the side panel other than the side panel bent edge; and the side panel and the web plate are parallel to each other, and a hollow web is formed between the side panel and the web plate.

7 Claims, 3 Drawing Sheets

(56) References Cited

U.S. PATENT DOCUMENTS

| | | | | | |
|---|---|---|---|---|---|
| 1,956,797 | A | * | 5/1934 | Jackson et al. | 254/3 B |
| 1,994,783 | A | * | 3/1935 | Pfauser | 254/2 B |
| 2,012,430 | A | * | 8/1935 | Kuhlman | 254/89 H |
| 2,026,507 | A | * | 12/1935 | Green et al. | 254/2 B |
| 2,032,309 | A | * | 2/1936 | Rechard et al. | 254/2 B |
| 2,036,654 | A | * | 4/1936 | Stieler | 254/2 B |
| 2,039,895 | A | * | 5/1936 | Green | 254/2 B |
| 2,039,896 | A | * | 5/1936 | Green | 254/2 B |
| 2,044,857 | A | * | 6/1936 | Pfauser | 137/565.19 |
| 2,054,555 | A | * | 9/1936 | Cochin | 254/2 B |
| 2,080,963 | A | * | 5/1937 | Fledler | 254/2 B |
| 2,085,720 | A | * | 6/1937 | Nilson | 254/2 B |
| 2,145,014 | A | * | 1/1939 | Rosenberry | 254/2 B |
| 2,156,543 | A | * | 5/1939 | Pfauser | 254/2 B |
| 2,189,010 | A | * | 2/1940 | Lewis | 414/680 |
| 2,219,903 | A | * | 10/1940 | Pfauser | 362/486 |
| 2,231,047 | A | * | 2/1941 | Ziska | 254/2 B |
| 2,233,745 | A | * | 3/1941 | Nilson | 254/2 B |
| 2,335,130 | A | * | 11/1943 | Moran | 254/2 B |
| 2,433,900 | A | * | 1/1948 | Grime | 254/10 B |
| 2,455,440 | A | * | 12/1948 | Page | 254/2 B |
| 2,588,509 | A | * | 3/1952 | Forster | 72/392 |
| 2,605,999 | A | * | 8/1952 | Schultz | 254/10 B |
| 2,610,025 | A | * | 9/1952 | Mueller | 254/2 B |
| 2,629,583 | A | * | 2/1953 | Mueller | 254/8 B |
| 2,702,988 | A | * | 3/1955 | Rhoads et al. | 60/468 |
| 2,860,852 | A | * | 11/1958 | Lewis, Jr. | 254/10 B |
| 2,867,409 | A | * | 1/1959 | Southerwick | 254/2 B |
| 2,947,513 | A | * | 8/1960 | Nolden et al. | 254/2 B |
| 3,044,747 | A | * | 7/1962 | Nolden | 254/2 B |
| 3,181,836 | A | * | 5/1965 | Arnes et al. | 254/8 B |
| 3,195,860 | A | * | 7/1965 | Simms | 254/2 B |
| 3,521,861 | A | * | 7/1970 | Freudenthal et al. | 254/93 L |
| 4,210,314 | A | * | 7/1980 | Carroll et al. | 254/8 B |
| 4,277,048 | A | * | 7/1981 | Okuda | 254/8 B |
| 5,221,073 | A | * | 6/1993 | Shockley | 254/8 B |
| 5,618,029 | A | * | 4/1997 | Chung | 254/8 B |
| 5,732,931 | A | * | 3/1998 | Massel | 254/8 B |
| 5,984,270 | A | * | 11/1999 | Hussaini et al. | 254/8 B |
| 6,086,047 | A | * | 7/2000 | Lee | 254/8 B |
| 6,089,545 | A | * | 7/2000 | Norman et al. | 254/134 |
| 6,264,169 | B1 | * | 7/2001 | Hung | 254/8 B |
| 6,416,039 | B1 | * | 7/2002 | Pietrusynski | 254/8 B |
| 6,435,477 | B2 | * | 8/2002 | Brunnhoelzl | 254/8 B |
| 6,581,909 | B2 | * | 6/2003 | Wixey | 254/8 B |
| 6,622,485 | B2 | * | 9/2003 | Hung | 60/477 |
| D483,169 | S | * | 12/2003 | Fox | D34/31 |
| 6,848,673 | B1 | * | 2/2005 | McLaughlin et al. | 254/8 B |
| 6,986,503 | B2 | * | 1/2006 | Arzouman | 254/8 B |
| 7,137,615 | B2 | * | 11/2006 | Ray et al. | 254/10 B |
| 7,175,159 | B1 | * | 2/2007 | Gomillion | 254/8 R |
| 7,243,906 | B2 | * | 7/2007 | Pagliarani | 254/8 B |
| 7,334,774 | B1 | * | 2/2008 | Lin et al. | 254/8 B |
| 7,347,409 | B2 | * | 3/2008 | Goza | 254/2 B |
| 7,410,148 | B2 | * | 8/2008 | Arzouman | 254/8 B |
| 7,410,149 | B2 | * | 8/2008 | Arzouman | 254/8 B |
| 7,413,166 | B2 | * | 8/2008 | Arzouman | 254/8 B |
| 7,413,167 | B2 | * | 8/2008 | Arzouman | 254/8 B |
| 7,413,169 | B2 | * | 8/2008 | Arzouman | 254/8 B |
| 7,431,265 | B2 | * | 10/2008 | Yueh | 254/8 B |
| 7,434,782 | B2 | * | 10/2008 | Arzouman | 254/8 B |
| 7,434,783 | B2 | * | 10/2008 | Arzouman | 254/8 B |
| 7,648,121 | B2 | * | 1/2010 | Arzouman | 254/8 B |
| 7,703,747 | B2 | * | 4/2010 | Arzouman | 254/8 B |
| 8,066,259 | B2 | * | 11/2011 | Fang et al. | 254/8 B |
| 8,118,279 | B2 | * | 2/2012 | Lin | 254/8 B |
| 8,297,595 | B2 | * | 10/2012 | Shen et al. | 254/93 R |
| 8,366,074 | B2 | * | 2/2013 | Lin | 254/8 B |
| 8,366,077 | B2 | * | 2/2013 | Hsu | 254/93 R |
| 8,376,319 | B2 | * | 2/2013 | Chen et al. | 254/93 R |
| 8,448,921 | B2 | * | 5/2013 | Hernandez | 254/88 |
| 8,500,095 | B1 | * | 8/2013 | Salcedo | 254/2 B |
| 8,540,214 | B2 | * | 9/2013 | Christian | 254/93 R |
| 8,608,131 | B2 | * | 12/2013 | Kania | 254/2 B |
| 8,622,369 | B2 | * | 1/2014 | Kania | 254/2 B |
| 8,632,055 | B2 | * | 1/2014 | Lee et al. | 254/8 B |
| 2011/0024705 | A1 | * | 2/2011 | Fox et al. | 254/2 B |
| 2011/0193035 | A1 | * | 8/2011 | Kania | 254/1 |
| 2013/0153839 | A1 | * | 6/2013 | Shen et al. | 254/2 B |

* cited by examiner

HOLLOW FLOOR-JACK WEB-PLATE TYPE CHASSIS SIDE PANEL ASSEMBLY

FIELD OF THE INVENTION

The present invention relates to the technical field of automobile floor jack technology and an automobile floor-jack chassis side panel, in particular to a hollow floor-jack web-plate type chassis side panel assembly.

BACKGROUND OF THE INVENTION

A floor jack is a rigid jacking device used as a small and light lifting tool for lifting heavy objects within a small stroke of a support base at the top of the floor jack. The floor jack is an important hydraulic tool widely used for cars or movable equipments to support the weight of a car or moving equipment in order to adjust the equipment and mainly used for car repairs or other lifting and supporting jobs in factories, mines, or traffic departments. The floor jack generally comprises a chassis, a cylinder, a lever and a lifting frame, and a chassis is the main support part of the floor jack, so that the strength of the chassis is the most important parameter to the floor jack.

At present, an automobile floor-jack chassis side panel available generally adopts a single-layer steel sheet, a bent single-layer steel sheet, or a reinforcing board attached onto the aforementioned steel sheets, and such design has the following problems:

1. The structure of the single-layer steel sheet or the bent single-layer steel is made of a uniform thickness, and thus cannot reinforce the portion having the largest load or force exerted thereon. To meet the load carrying requirement, the thickness of the steel sheet must be increased, and thus causing an unnecessary waste of material and a low utilization of the material,
2. Even though the reinforcing board is attached onto the surface of the aforementioned steel sheets to partially reinforce the structure to a certain extent, yet such design cannot overcome the problem of the low anti-bending ability and the poor overall aesthetic look of the product.

Therefore, it is an important and urgent subject for related manufacturers to develop a chassis side panel with the high utilization rate and anti-bending ability.

SUMMARY OF THE INVENTION

Therefore, it is a primary objective of the present invention to overcome the aforementioned problems of the prior art by providing a hollow floor-jack web-plate type chassis side panel assembly capable of improving the utilization of material, and achieving the same structural strength with a smaller quantity of material.

To achieve the aforementioned objective, the present invention provides a hollow floor-jack web-plate type chassis side panel assembly comprising a side panel, a reserved installation hole formed on the side panel, and a side panel bent edge disposed at the position of a lower edge of the side panel, characterized in that the assembly further comprises a web plate having an installation hole formed at a position corresponding to the web plate; the web plate has an edge including a first web plate molded edge and a second web plate molded edge perpendicular to the web plate; the first and second web plate molded edges are arranged in the same direction; the first web plate molded edge is attached and welded onto a side panel bent edge facing away from the side panel; the second web plate molded edge is attached and welded at a position on the side panel other than the side panel bent edge; and the side panel and the web plate are parallel to each other, and a hollow web is formed between the side panel and the web plate.

To increase the partial strength of the side panel assembly, the hollow web includes a reinforcing adhesive board welded at a position of the side panel where forces are concentrated according to the structural strength requirement. The first web plate molded edge and the second web plate molded edge are continuously arranged one after the other.

Further, the first web plate molded edge is continuously arranged in a curved shape, and the curved design can guarantee the first web plate molded edge can have at least three nonlinear points to facilitate the web plate and the side panel to be installed quickly, and the web plate and the side panel are parallel to each other.

The second web plate molded edge has a width greater than or equal to the sum of the width of the first web plate molded edge and the thickness of the side panel thickness. Preferably, the second web plate molded edge has a width equal to the sum of the width of the first web plate molded edge, the thickness of the side panel and the width of the side panel bent edge.

The web plate has a height smaller than or equal to the height of the side panel at a corresponding position. The reinforcing adhesive board has a thickness smaller than or equal to the width of the first web plate molded edge. The seams of the welding are situated under the inner side of the second web plate molded edge and the bottom of the first web plate molded edge, so that all welding seams falls outside the top view of the line of sight to improve the appearance of the product.

In summation, the present invention has the following advantages and effects:

1. The structure of the side panel together with the web plate forms a hollow rectangular web cavity, such that the longitudinal and lateral anti-bending strength of the chassis side panel can be enhanced when the floor jack carries a load.
2. The reinforcing adhesive board is welded at a position of the side panel where forces are concentrated according to the structural strength requirement, so that the longitudinal and lateral torque of the chassis side panel can be enhanced when the floor jack carries a load, so as to achieve the effects of bearing a heavier load with the same material used, saving the consumption of material, and lowering the cost.
3. The welding point is set at the inner side of the second web-plate molded edge and the lower side of the first web plate molded edge, so that the welding seams are out of the top view of the line of sight. Meanwhile, the reinforcing adhesive board can be installed in the hollow web to make the appearance of the product better to increase the product quality.

DESCRIPTION OF THE PREFERRED EMBODIMENTS

The present invention will become clearer in light of the following detailed description of an illustrative embodiment of this invention described in connection with the drawings. It is intended that the embodiments and drawings disclosed herein are to be considered illustrative rather than restrictive.

Figure 1:
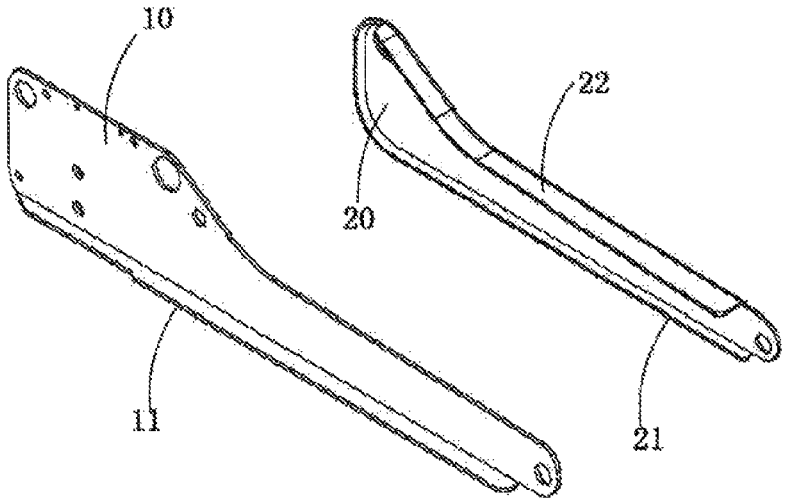
FIG. 1 is an exploded view of the assembly of the present invention.
Figure 2:
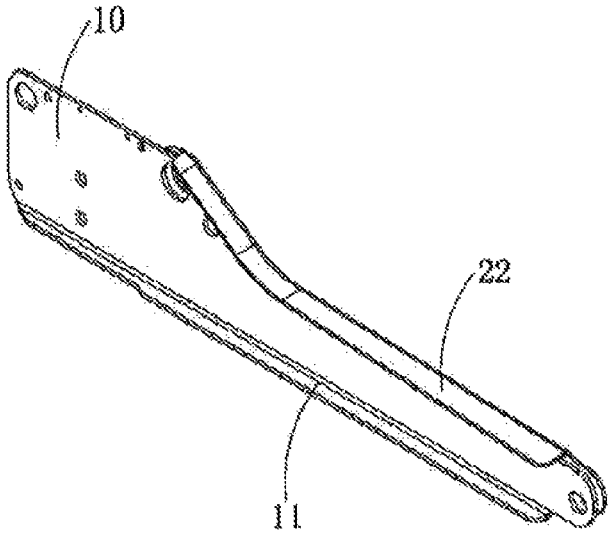
FIG. 2 is a perspective view of the assembly of the present invention.
Figure 3:
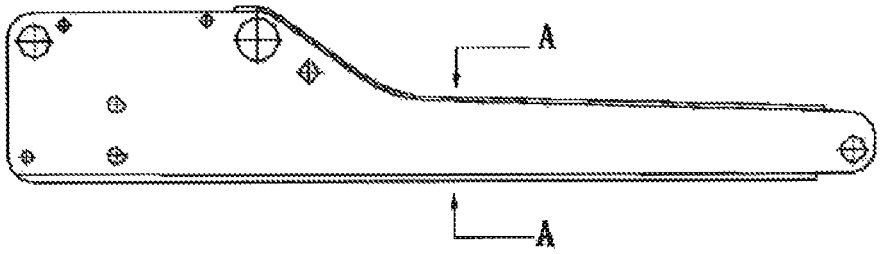
FIG. 3 is a front view of the assembly of the present invention.
Figure 4:
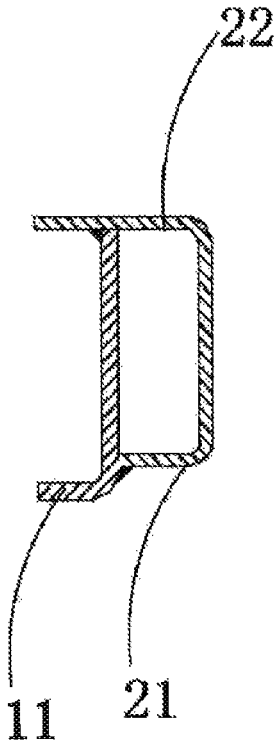
FIG. 4 is a cross-sectional view of Section A-A as depicted in FIG. 3.

With reference to FIGS. 1, 2 and 4 for an exploded view, a perspective view and a front view of a hollow floor-jack web-plate type chassis side panel assembly in accordance with the present invention respectively, the hollow floor-jack web-plate type chassis side panel assembly comprises a side panel 10, a reserved installation hole formed on the side panel 10, and a side panel bent edge 11 disposed at a lower edge of the side panel 10, and the assembly further comprises a web plate 20 having an installation hole formed at a position corresponding to the web plate 20; the web plate 20 has an edge including a first web plate molded edge 21 and a second web plate molded edge 22 perpendicular to the web plate 20; the first web plate molded edge 21 and the second web plate molded edge 22 are arranged in the same direction; the first web plate molded edge 21 is attached and welded onto a side panel bent edge 11 facing away from the side panel 10; the second web plate molded edge 22 is attached and welded at a position on the side panel 10 other than the side panel bent edge 11; and the side panel 10 and the web plate 20 are parallel to each other, and a hollow web is formed between the side panel 10 and the web plate 20.

Figure 5:
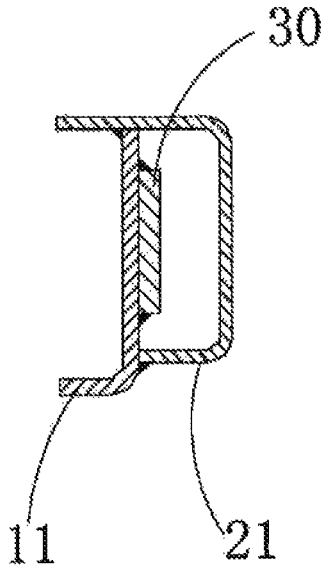
FIG. 5 is a cross-sectional view of Section A-A as depicted in FIG. 3, and a reinforcing adhesive board is added in the web in FIG. 5.

To increase the partial strength of the side panel assembly, the hollow web includes a reinforcing adhesive board 30 welded at a position of the side panel 10 where forces are concentrated according to the structural strength requirement as shown in FIG. 5.

The first web plate molded edge 21 and the second web plate molded edge 22 are continuously arranged one after the other. Further, the first web plate molded edge 21 is continuously arranged in a curved shape, and the curved design can guarantee the first web plate molded edge 21 can have at least three nonlinear points to facilitate the web plate 20 and the side panel 10 to be installed quickly, and the web plate 20 and the side panel 10 are parallel to each other.

The second web plate molded edge 22 has a width greater than or equal to the sum of the width of the first web plate molded edge 21 and the thickness of the side panel 10. Preferably, the second web plate molded edge 22 has a width equal to the sum of the width of the first web plate molded edge 21, the thickness of the side panel 10 and the width of the side panel bent edge 11.

The web plate 20 has a height smaller than or equal to the height of the side panel 10 at a corresponding position. The reinforcing adhesive board 30 has a thickness smaller than or equal to the width of the first web plate molded edge 21.

In FIG. 4 or 5, the welding seams of the welding are situated under the inner side of the second web plate molded edge 22 and the bottom of the first web plate molded edge 21, so that all welding seams falls outside the top view of the line of sight to improve the appearance of the product.

Figure 6:
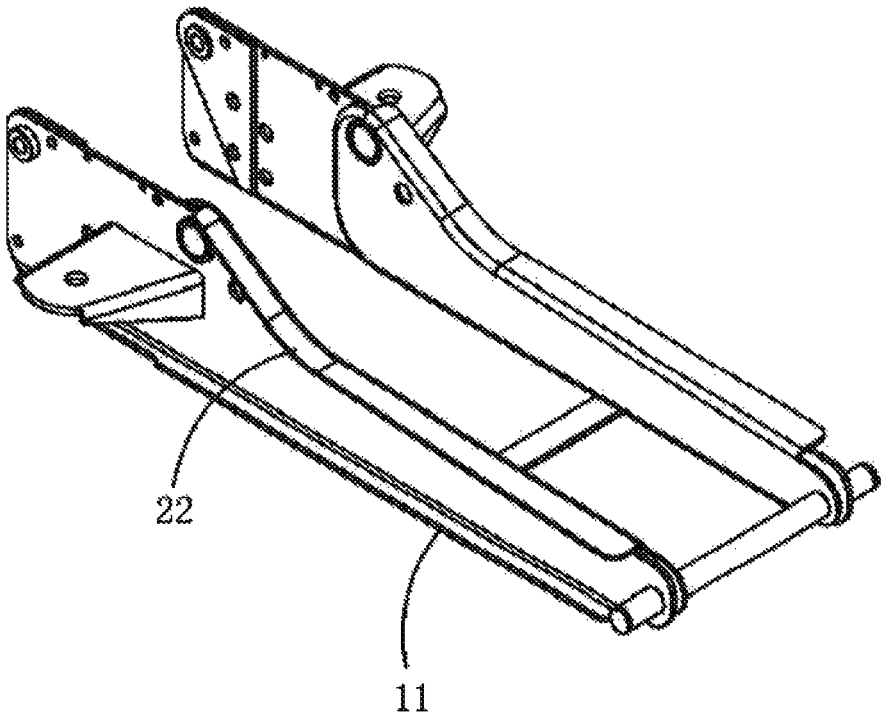
FIG. 6 is a floor-jack chassis assembly of the present invention.

In FIG. 6, the side panel 10, the web plate 20 and the reinforcing adhesive board 30 are welded to form the side panel assembly for use, and a pair of symmetric side panel assemblies can be passed through the reserved installation hole and fixed together by a fastener to form a floor-jack chassis.

The product specification of the present invention and the thickness of the steel sheet have the relations of 2.75 T floor jack: side panel of 3 mm thick; and 3.25 T floor jack: side panel of 4 mm, which are up to the national standards The material of the 3.25 T floor jack is used as an example for illustrating the invention, a jack of regular specification weighs 12.62 Kg, and the jack of this invention weighs 8.66 Kg (according to the data collected during the use of the chassis of the product of the present invention, so that each chassis can save 4 Kg of material. If 20,000 sets are produced yearly, 80,000 Kg of material can be saved. Each ton of material costs about 4500 RMB dollars, so that 360,000 RMB dollars can be saved yearly. The chassis produced according to the design of the present invention even exceeds the standards ASME PALD-2009 established by the United States and EN1494 established by Europe.

While the invention has been described by means of specific embodiments, numerous modifications and variations could be made thereto by those skilled in the art without departing from the scope and spirit of the invention set forth in the claims.

What is claimed is:

1. A hollow floor-jack web-plate type chassis side panel assembly, comprising a side panel, a reserved installation hole formed on the side panel, and a side panel bent edge disposed at the position of a lower edge of the side panel, characterized in that the assembly further comprises a web plate having an installation hole formed at a position corresponding to the web plate; the web plate edge has an edge including a first web plate molded edge and a second web plate molded edge perpendicular to the web plate; the first and second web plate molded edges are arranged in the same direction; the first web plate molded edge is attached and welded onto a side panel bent edge facing away from the side panel; the second web plate molded edge is attached and welded at a position on the side panel other than the side panel bent edge; and the side panel and the web plate are parallel to each other, and a hollow web is formed between the side panel and the web plate.

2. The hollow floor-jack web-plate type chassis side panel assembly of claim 1, wherein the hollow web in the side panel assembly is welded with a reinforcing adhesive board.

3. The hollow floor-jack web-plate type chassis side panel assembly of claim 2, wherein the reinforcing adhesive board has a thickness smaller than or equal to the width of the hollow web.

4. The hollow floor-jack web-plate type chassis side panel assembly of claim 1, wherein the first web plate molded edge and the second web plate molded edge are continuously arranged one after the other.

5. The hollow floor-jack web-plate type chassis side panel assembly of claim 1, wherein the second web plate molded edge has a width greater than or equal to the sum of the width of the first web plate molded edge and the thickness of the side panel.

6. The hollow floor-jack web-plate type chassis side panel assembly of claim 5, wherein the second web plate molded edge has a width equal to the sum of the width of the first web plate molded edge, the thickness of the side panel thickness, and the width of the side panel bent edge.

7. The hollow floor-jack web-plate type chassis side panel assembly of claim 1, wherein the web plate has a height smaller than or equal to the height of the side panel at a corresponding position.

* * * * *